US006428284B1

(12) United States Patent
Vaisman

(10) Patent No.: US 6,428,284 B1
(45) Date of Patent: Aug. 6, 2002

(54) ROTARY VANE COMPRESSOR WITH ECONOMIZER PORT FOR CAPACITY CONTROL

(75) Inventor: Igor Vaisman, Thornhill (CA)

(73) Assignee: Mobile Climate Control Inc.

( * ) Notice: Subject to any disclaimer, the term of this patent is extended or adjusted under 35 U.S.C. 154(b) by 0 days.

(21) Appl. No.: 09/526,453

(22) Filed: Mar. 16, 2000

(51) Int. Cl.[7] ..... F04B 49/00; F04B 23/00

(52) U.S. Cl. ..... 417/213; 417/290; 417/310; 417/440

(58) Field of Search ..... 417/295, 290, 417/213, 292, 297, 440, 310

(56) References Cited

U.S. PATENT DOCUMENTS 3,912,422 A * 10/1975 Funke ..... 417/310
4,068,981 A * 1/1978 Mandy ..... 417/310
4,502,850 A * 3/1985 Inagaki et al. ..... 417/440
4,892,466 A * 1/1990 Taguchi et al. ..... 417/295
5,199,855 A * 4/1993 Makajima et al. ..... 417/295

* cited by examiner

*Primary Examiner*—Charles G. Freay

(57) ABSTRACT

The present invention is directed to a method of reducing cooling capacity in a rotary vane compressor in such a way that the power requirement to drive the rotor is reduced to the same extent (or close to) as capacity is reduced. An economizer port operating in economizing and unloading cycles is located in the compression region at a point after the compression chamber has been closed for the compression and at a point where sufficient both unloading (reducing) and economizing (increasing) capacities are provided. A valve is associated with the economizer port, the valve body being formed from a part of the stator body. A seat of the valve in the closed position is shaped to be contiguous with the wall portion of the stator. In an opened position the valve provides conmumnication between the compression chamber and an external portion of the economizer port.

4 Claims, 3 Drawing Sheets

ROTARY VANE COMPRESSOR

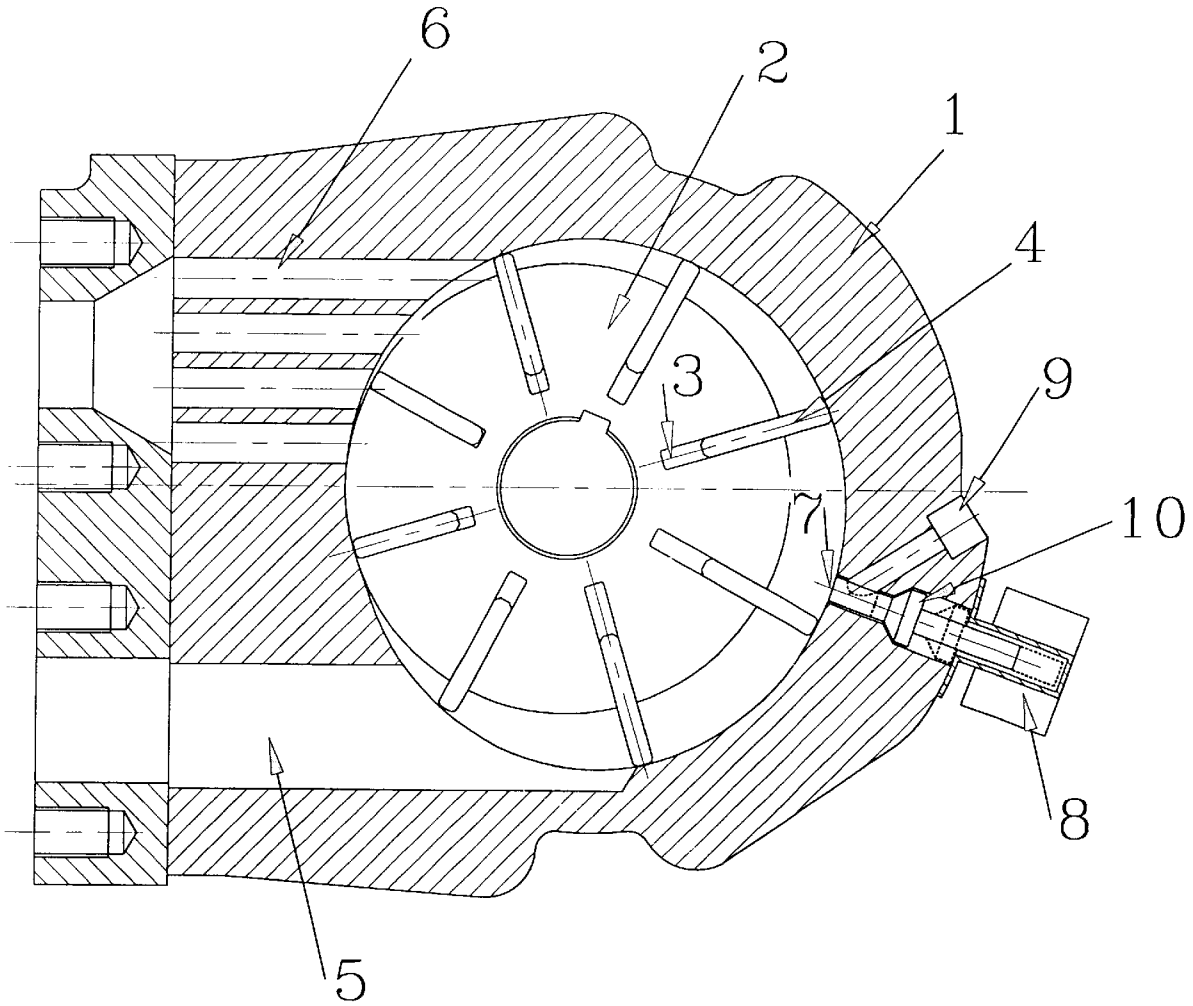
FIGURE 1: ROTARY VANE COMPRESSOR

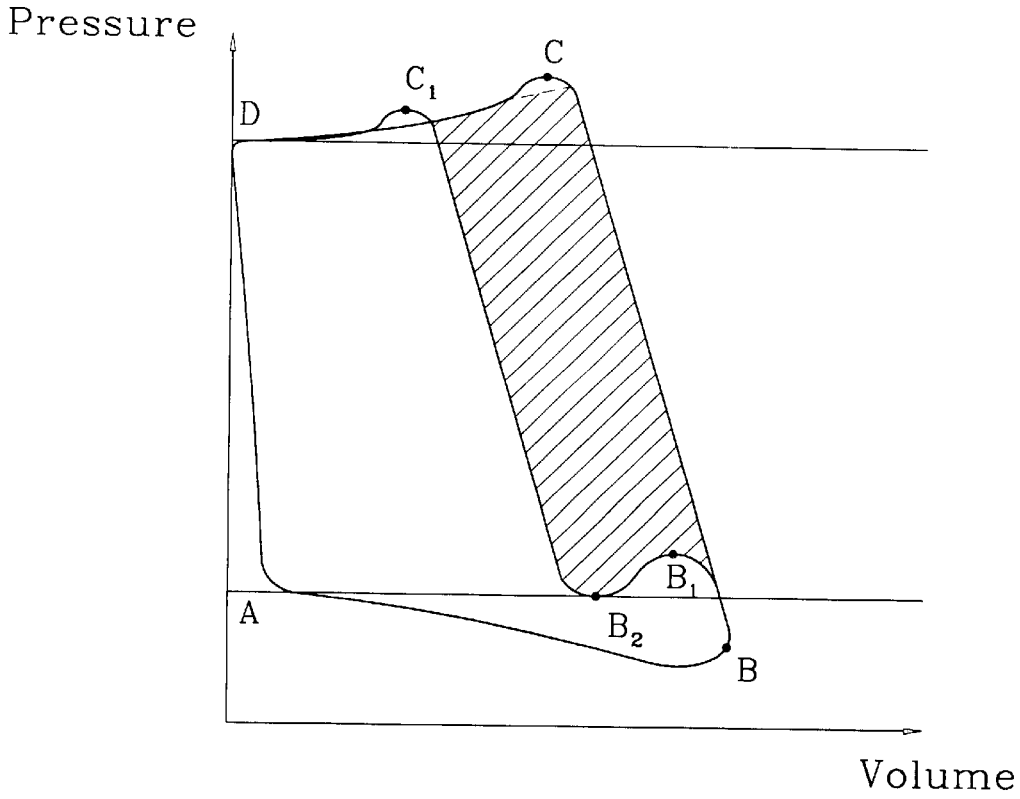
FIGURE 2: CYCLE OF ROTARY COMPRESSOR

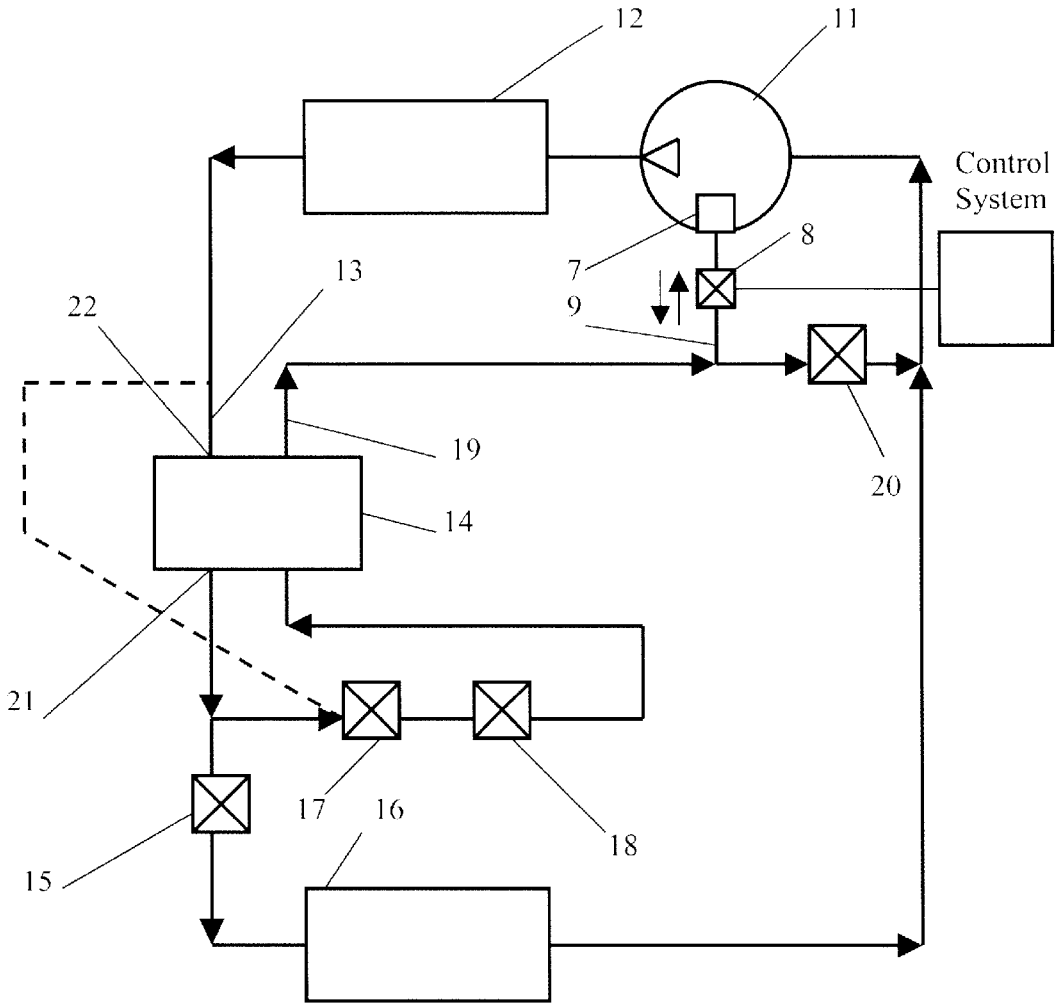
FIGURE 3: REFRIGERATION SYSTEM

ROTARY VANE COMPRESSOR WITH ECONOMIZER PORT FOR CAPACITY CONTROL

FIELD OF THE INVENTION

The invention relates to pumps used to move a gas from one place or location (inlet) to another place or location (outlet) different from whence it came. In particular, the invention relates to rotary vane compressors and refrigeration systems using unloading compressors.

BACKGROUND OF THE INVENTION

The main problem of controlling compression system capacity is to reduce both the capacity of the compressor and the power required to drive the compressor rotor to the same extent.

One commonly utilized means of achieving a capacity reduction is to bypass a portion of the fluid from the discharge side of the compressor back to the suction side. This method requires an auxiliary pipe connecting the discharge and suction sides of the compressor with a valve located in the pipe. Such an arrangement reduces the system capacity since a smaller amount of fluid is directed to the main system circuit, but it does not reduce the power consumption since the compressor pumps the same amount of fluid.

Another solution is to provide an auxiliary pipe, extending from the compressor outlet to an auxiliary inlet in the wall of the stator at a position where the rotor passes on its' return travel from the outlet to the main inlet. This introduces pressurized gas into the re-expansion process of the compressor cycle, where the expanding gas imparts a driving force on the rotor. This reduces both the cooling capacity and power required to drive the compressor rotor. However, this arrangement requires modifying the profile of the stator wall in the re-expansion zone. This results in an impact on the compressor efficiency at regular mode. Also, it limits the controlled capacity range for each modified profile.

On the other hand, in many refrigeration or refrigerant compression applications, there are other times when it would be more desirable to have the ability to also achieve increased capacity. One way of achieving increased capacity is the inclusion of an economizer circuit into the refrigerant system. Typically, the economizer fluid is injected through an economizer port at a point after the compression chambers have been closed.

In one design, the system is provided with an unloader valve which selectively communicates the economizer injection line back to suction. In this arrangement, the fluid ports and passages necessary to achieve the economizer injection are also utilized to achieve suction bypass unloading, and thus the compressor and system design and construction are simplified. However, operating in regular mode, the compressor chamber communicates with the additional volume of the passages, thus impacting compressor efficiency. If the passages are made too small to reduce the impact on compressor efficiency, unloading capacity would not be enough.

As a further development a pulsed flow capacity control is achieved by rapidly cycling solenoid valves in the suction line, the economizer circuit, and in a bypass line with the percent of "open" time for the valve regulating the rate of flow. The provision of three modulating valves results in an increased complexity and a reduced reliability of the whole refrigeration system.

SUMMARY OF THE INVENTION

The present invention is directed to a method of reducing cooling capacity in a rotary vane compressor in such a way that the power requirement to drive the rotor is reduced to the same extent (or close to) as capacity is reduced. In an aspect of the invention this is accomplished without any impact on compressor efficiency at regular mode. In another aspect, this is accomplished without excessive complexity or low reliability.

The present invention provides for a rotary vane compressor comprising a rotor, a stator, and vanes placed in slots spaced apart about the rotor. The stator is provided with an inlet and an outlet and a compression region therebetween. The rotor rotates in a forward direction past the inlet through the compression region and then past the outlet thereby to transport gas from the inlet to the outlet. Two adjacent vanes, the rotor and a wall portion of the stator in the compression region define a compressor chamber. The stator is shaped to compress gas in the compressor chamber when gas travels from the inlet to the outlet. An economizer port is located in the compression region at a point where the port is in communication with the compression chamber after it has been closed for compression. A valve is associated with the economizer port, the valve body being formed from a part of the stator body. The seat of the valve in the closed position is shaped to be contiguous with the wall portion of the stator. The integrity of the whole compressor is maintained and compressor cycle efficiency is improved since there is no additional volume of passages attached to the compressor chamber and associated with the economizer port. In an opened position the valve provides communication between the compression chamber and the economizer port.

According to an aspect of the invention, when the valve is opened a part of the gas is returned back to the compressor inlet over an auxiliary passage between the economizer port and the compressor suction side. This reduces both potential cooling capacity and power required to drive the compressor rotor without impacting compressor efficiency at regular operating mode.

In yet another aspect of the invention there is provided a refrigeration system comprising a main circuit, and a bypass circuit. The main circuit comprises, in a closed loop, a compressor, a condenser unit, an expansion device, an evaporator unit, connecting piping and appropriate refrigeration control. The compressor includes a housing, an inlet, an outlet, a compression region therebetween, an economizer port located in the compression region at a point where the port is in communication with the compression chamber after it has been closed for compression, and a variable flow valve associated with the economizer port. A body of the valve is a part of a body of the housing and a seat of the valve in a closed position is shaped to be contiguous with internal portion of the housing. The bypass circuit has a second solenoid valve located between the economizer port and the suction side of the compressor. The variable flow valve, a control system, and a transducer, reading parameters associated with a system capacity demand, are wired in an electrical circuit. The control system activates the valves based on the capacity demand.

One more aspect of the invention there is provided a refrigeration system comprising a main circuit, and an economizer circuit. The main circuit comprises, in a closed loop, a compressor, a condenser unit, an expansion device, an evaporator unit, connecting piping and appropriate refrigeration control. The compressor includes a housing, an inlet, an outlet, a compression region therebetween, an economizer port located in the compression region at a point where the port is in communication with the compression chamber after it has been closed for compression, and a variable flow valve associated with the economizer port. A body of the valve is a part of a body of the housing and a seat of the valve in a closed position is shaped to be contiguous with internal portion of the housing. The economizer circuit includes a first solenoid valve, an additional expansion device and an economizing heat exchanger and is connected to the economizer port. The economizing heat exchanger provides thermal contact between refrigerant in the main circuit after the condenser unit and evaporating refrigerant in the economizer circuit after the additional expansion device. The variable flow valve, a control system, and a transducer, reading parameters associated with a system capacity demand, are wired in an electrical circuit. The control system activates the valves based on the capacity demand.

When the economizer and bypass circuits are applied together the refrigeration system includes a first solenoid valve in the bypass circuit and a second solenoid valve in the economizer circuit.

According to the invention the refrigeration system has an advantage in terms of the system simplicity and reliability since only one variable flow valve is required.

BRIEF DESCRIPTION OF THE DRAWINGS

Preferred embodiments of the present invention are illustrated in the attached drawings in which:

FIG. 1 is a cross-sectional view of a rotary vane compressor with capacity control according to a preferred embodiment of the invention;

FIG. 2 is a graph illustrating the sequence of thermodynamic processes in rotary vane compressor with reducing capacity control of FIG. 1; and FIG. 3 is a schematic diagram of a Refrigeration System utilizing capacity control.

DETAILED DESCRIPTION OF THE PREFERRED EMBODIMENTS

A rotary vane compressor in accordance with the present invention as illustrated in FIG. 1. The rotary compressor has a housing, which is the compressor stator 1, and a rotor 2. The rotor 2 has slots 3 spaced apart along its periphery and movable vanes 4 inserted into the slots. The compression chamber is a space defined by two adjacent vanes 4, the rotor 2, and a portion of a wall of the stator 1. The stator has an inlet 5, an outlet 6, an economizer port 7, and a valve 8. The economizer port 7 is located in the stator body 1 between the inlet 5 and the outlet 6, in a position that allows the part 7 to communicate with the compression chamber after the compression chamber is closed for compression. An external outlet 9, associated with the economizer port 7, is intended for an auxiliary passage extended from the economizer port 7 to the compressor suction side or an economizer circuit. In relation to the stator 1, the auxiliary passage may be arranged outwardly and inwardly. The valve 8 is inwardly installed in the body of the stator 1. A seat 10 of the valve 8 in a closed position is shaped to be contiguous with the wall portion of the stator 1.

The compressor could be provided with a plurality of the economizer ports and seats providing contiguous shape of seats in respect to the wall portion of the stator 1.

Normally, the valve 8 is completely closed. If a mode of reduced capacity is required, then the valve 8 is opened, and communication with the economizer circuit is enabled or described further below. If a mode of increased capacity is required, then the valve 8 is opened and communication with the suction side is enabled as also described below.

The valve 8 may be of three types: a solenoid valve, a control (or modulating) valve, or a pulsing valve.

If a solenoid valve is used, then only open and closed positions are possible and therefore only one step of reducing (or increasing) capacity is provided.

If a control valve is used, then any position of the valve seat between open and closed is possible and a capacity range is provided from minimal to nominal in the mode of reduced capacity or from nominal to maximal in the mode of increased capacity.

A pulsing valve is actuated to be opened within a period of time, and is in the closed position other periods of time. When actuated, the valve seat could stay in an opened position for a preselected time providing capacity range from minimal to nominal in the mode of reduced capacity or from nominal to maximal in the mode of increased capacity.

The position and timing of the valve 8 is defined by a control system on a signal associated with capacity demand. Such a signal is sent from a transducer measuring one of the following parameters: discharge or suction pressure, condensing temperature, refrigerant temperature after condenser, boiling temperature, ambient temperature, temperature of the object to be cooled, etc.

The economizer port 7 is preferably located as close to the inlet 5 as possible. The location is defined by an intermediate pressure in the compressor chamber, which is necessary to discharge required amount of gas back to the suction line over all arrangements made for that. If the location is too close to the inlet 5, then the proper intermediate pressure is not achieved. If the location is too far from the outlet 6, then excessive intermediate pressure is built up and excessive compression work is done. The required intermediate pressure depends on the economizer port 7 geometry. The larger the cross-sectional area of the port 7 is and the smaller the flow resistance, the lower intermediate pressure is required.

Normally the compressor cycle includes four stages (FIG. 2): inducing a portion of gas from the suction line into the compression chamber—AB, compression of the induced portion—BC, discharge of the compressed portion into the discharge line—CD, and re-expansion of gas left in the compressor chamber—DA.

In accordance with the invention, in the mode of reduced capacity, the compressor cycle includes six stages: inducing a portion of gas from the suction line into the compression chamber—AB; compression of the induced portion to an intermediate pressure—$BB_1$; discharge of a part of the compressed portion back to the suction line—$B_1B_2$, compression of the rest of gas—$B_2C_1$; discharge of the compressed gas into discharge line—$C_1D$, and re-expansion of gas left in the compressor chamber—DA. Volume BA is the original swept volume. Volume $B_2A$ is a reduced swept volume. Area ABCDA is the original compressor work. Area $ABB_1B_2C_1DA$ is the reduced compressor work. The shaded area is the difference between the original and reduced work.

An arrangement for the compressor as described above allows the integrity of the whole compressor to be maintained. Another advantage of the compressor arrangement is the improved compressor cycle efficiency since there is no additional volume of passages attached to the compressor chamber and associated with the economizer port.

In some refrigeration, air conditioning, and heat pump applications it is required to have both abilities, to increase and to decrease capacity. A refrigeration system, realizing all those, consists of three circuits: a main circuit, an economizer circuit for the increased capacity mode, and a bypass circuit for the decreased capacity mode.

The main circuit includes a compressor 11, a condenser 12, a high pressure side 13 of a regenerative heat exchanger 14, an-expansion valve 15, and an evaporator 16. The compressor 11 has the economizer port 7, the variable flow (including a solenoid type) valve 8, and the outlet 9. A seat of the valve 8 in a closed position is shaped to be contiguous with the wall portion of the compression chamber.

The compressor could be provided with a plurality of the economizer ports and seats providing contiguous shape of seats providing contiguous shape of seats in respect to the wall portion of the compression chamber.

The economizer circuit includes a solenoid valve 17, an auxiliary expansion valve 18, and a low pressure side 19 of the regenerative heat exchanger 14.

The bypass circuit includes a solenoid valve 20.

Both economizer and bypass loops, communicate with the economizer port 7 over the valve 8 and outlet 9 at one end. The economizer circuit at the other end is connected either to an outlet 21 of the high pressure side 13 of the regenerative heat exchanger 14 or, as an option, to an inlet 22. The bypass loop circuit at the other end is connected to the compressor suction line.

In the regular mode the valves 8, 17 and 20 are closed and the refrigeration system operates as follows. The compressor 11 induces vapor at low pressure from the evaporator 16, compresses it to high pressure, and discharges the compressed vapor into condenser 12. In the condenser vapor is liquefied. Liquid refrigerant after the condenser 12 passes the high pressure side 13 of the regenerative heat exchanger 14, expands in the expansion valve 15 from high pressure to low pressure turning the liquid into a mixture of vapor and liquid, and enters the evaporator 16. In the evaporator 16, the liquid phase of the mixture is boiled out, absorbing heat from objects to be cooled. Vapor, appearing at the evaporator outlet, is induced by the compressor and the thermodynamic cycle is reproduced.

In the increased capacity mode, the valves 8 and 17 are opened and the valve 20 is closed. In this mode a part of refrigerant flow at the outlet 21 (or at the inlet 22 as shown with a dashed line) of the regenerative heat exchanger 14 is expanded in the expansion valve 18 from high pressure to low pressure turning the liquid to a mixture of vapor and liquid. Then the mixture enters the low pressure side 19 of the regenerative heat exchanger 14. In the heat exchanger 14 the liquid phase is boiled out, subcooling liquid refrigerant flow in the high pressure side 13. Vapor, appearring at the heat exchanger outlet 21, is introduced into compression process over the economizer port 7 without any effect on refrigerant flow induced by the compressor 11 from the suction line. This additional subcooling increases total cooling capacity.

If the valve 8 is a solenoid one, then the system generates two levels of system capacity: a nominal capacity, when the valve is closed, and a maximal capacity, when the valve is opened.

If the valve 8 is a control valve, then the system generates any intermediate capacity from the nominal one, when the valve is completely closed, to the maximal one, when the valve is completely opened. The intermediate capacity between the nominal and maximal ones is provided at intermediate positions of the valve seat depending on the capacity demand.

If the valve 8 is a pulsing one, then the system when the valve is closed for the full pulsing cycle, to the maximal one, when the valve is opened for the full pulsing cycle. The intermediate capacity between the nominal and maximal ones is provided by the relation between the time or opened position, to the time or portion of the pulsing cycle when the valve seat is at a closed position, depending on the capacity demand.

In the decreased capacity mode the valve 17 is part of the refrigerant flow from the economizer port 7 is returned back to the suction line, decreasing the amount of refrigerant circulating over the main circuit.

If the valve 8 is a solenoid one, then the system generates two levels of system capacity: a nominal capacity, when the valve is closed, and a minimal capacity, when the valve is opened.

If the valve 8 is a control valve, then the system generates any intermediate capacity from the nominal one, when the valve is closed, to the minimal one, when the valve is opened. The intermediate capacity between the nominal and maximal ones is provided at intermediate positions of the valve seat depending on the capacity demand.

If the valve 8 is a pulsing one, then the system generates any intermediate capacity from the nominal one, when the valve is closed for the full pulsing cycle, to the minimal one, when the valve is opened for the full pulsing cycle. The intermediate capacity between the nominal and maximal ones is provided by the relation between the time or portion of the pulsing cycle when the valve seat is at an opened position, to the time or portion of the pulsing cycle when the valve seat is at a closed position, depending on the capacity demand.

If a transcritical refrigerant (such as carbon dioxide) is applied, than instead of the condenser 12, a gas cooler is applied since instead of the condensation process the transcritical heat rejection process takes place.

The refrigeration system described above has only one variable flow valve, which is an advantage in terms of the system simplicity and reliability.

While certain preferred embodiments of the present invention have been disclosed in detail, it is to be understood that various modifications in its structure may be adopted without departing from the spirit of the invention or the scope of the following claims

I claim:

1. A rotary vane compressor comprising:

(a) a stator having an inlet and an outlet;

(b) a rotor rotating in a forward direction past said inlet and said outlet thereby to transport gas from said inlet to said outlet;

(c) vanes placed in slots spaced apart about said rotor;

(d) an compression chamber defined by two adjacent vanes, said rotor and a wall portion of said stator being shaped to compress gas in said compression chamber when gas travels from said inlet to said outlet;

(e) an economizer port located at a point between the inlet and the outlet at a point where the port is in communication with the compression chamber after the compression chamber has been closed for compression;

(f) a valve associated with said economizer port;

(g) a body of said valve being a part of a body of said stator; and (h) a seat of said valve in a closed position being shaped to be contiguous with said wall portion and in an opened position provides communication between said compression chamber and an external outlet of said economizer port.

2. A rotary vane compressor as recited in claim 1 wherein an actuating means of said valve provides an opened or a closed position of said seat.

3. A rotary vane compressor as recited in claim 1 wherein an actuating means of said valve provides any position of said seat between closed and opened including said closed and opened positions.

4. A rotary vane compressor as recited in claim 1 wherein an actuating means of said valve provides a certain time of pulsing cycle and a relation between time, when said seat of said valve is in opened position, and between time, when said seat of said valve is in closed position, including completely opened and closed positions.

* * * * *